United States Patent [19]

Boulton

[11] 4,154,665

[45] May 15, 1979

[54] DIAPHRAGM CELL

[75] Inventor: Thomas W. Boulton, Runcorn, England

[73] Assignee: Imperial Chemical Industries Limited, London, England

[21] Appl. No.: 818,863

[22] Filed: Jul. 25, 1977

[30] Foreign Application Priority Data

Aug. 4, 1976 [GB] United Kingdom ..... 32487/76

[51] Int. Cl.[2] ..... C25B 11/02; C25B 11/10; C25B 13/08

[52] U.S. Cl. ..... 204/253; 204/284; 204/286; 204/290 F; 204/256

[58] Field of Search ..... 204/286, 290 F, 283, 204/284, 253, 256

[56] References Cited

U.S. PATENT DOCUMENTS

| | | | |
|---|---|---|---|
| 1,269,128 | 6/1918 | Stuart | 204/284 |
| 1,881,713 | 10/1932 | Laukel | 204/DIG. 7 |
| 3,297,560 | 1/1967 | Schleicher | 204/250 |
| 3,507,771 | 4/1970 | Donges et al. | 204/284 |
| 3,751,296 | 8/1973 | Beer | 204/290 F X |
| 3,930,981 | 1/1976 | De Nora et al. | 204/256 |
| 3,969,216 | 7/1976 | Barrett | 204/286 |
| 4,013,525 | 3/1977 | Emsley | 204/98 |
| 4,032,423 | 6/1977 | Cunningham | 204/254 |

FOREIGN PATENT DOCUMENTS

| | | | |
|---|---|---|---|
| 1431954 | 2/1966 | France | 204/290 F |

*Primary Examiner*—F.C. Edmundson

*Attorney, Agent, or Firm*—Cushman, Darby & Cushman

[57] ABSTRACT

An anode suitable for use in a chlor-alkali diaphragm cell comprised of one or two groups of coated film-forming metal parallel elongated members lying in a plane, or in separate parallel planes connected to one another. The members (e.g. wires) extend lengthwise from the point of connection and are resiliently mounted to give them flexibility.

26 Claims, 3 Drawing Figures

DIAPHRAGM CELL

Figure 1:
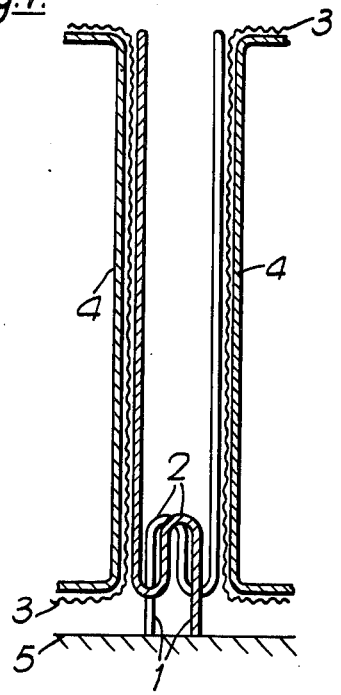

This invention relates to improvements in electrolytic diaphragm cells.

More particularly, it relates to electrolytic diaphragm cells having anodes of a film-forming metal and which carry an electrocatalytically active coating. It especially relates to diaphragm cells for the electrolysis of aqueous solutions of alkali-metal halides.

A wide variety of diaphragm cells are known which consist in principle of a series of anodes and a series of cathodes disposed in a parallel alternating manner and separated from each other by a substantially vertical diaphragm. In cells of recent design, the anodes are suitably in the form of plates of a film-forming metal (usually titanium) and carry an electrocatalytically active coating (for example a platinum group metal oxide); the cathodes are suitably in the form of a perforated plate or guaze of metal (usually mild steel); and the diaphragms, which are usually deposited on or fitted to the surface of the cathodes, are suitably made of asbestos or a synthetic organic polymer material, for example polytetrafluoroethylene or polyvinylidene fluoride.

In operating a diaphragm cell, it is advantageous to operate with as small a distance as possible between the anode and the cathode (the anode/cathode gap) in order to keep the ohmic losses (and hence the cell voltage) to a minimum. At the same time it is desirable to operate at an economic current density, for example 2 $KA/m^2$.

The use of high current densities results in a high rate of evolution of gas (for example chlorine) during electrolysis and if this evolution takes place in a narrow anode/cathode gap, it can in turn cause a foam of gas and electrolyte. This foam can partially fill the anode/-cathode gap in the anolyte compartment, thus driving the electrolyte out of the gap and increasing the resistance to further electrolysis. This problem has been mitigated by using metal anodes provided with a plurality of vertically disposed elongated members (e.g. blades, rods, channel shaped, members) to facilitate the removal of gas from the surface, for example as described in our copending UK application Nos. 44682/73 and 29683/74 (published as Belgian Patent Specification No. 820295). Such metal anodes, when made of a film-forming metal, for example titanium, are relatively expensive to make as compared with solid-plate anodes. Moreover, the diaphragms are generally in contact with the foraminour cathode, but the achievement of small anode/cathode gaps without any possibility of damage to the diaphragm requires considerable accuracy of manufacture in the preparation of anodes of the required degree of flatness and maintenance of this flatness during the heat treatment involved in anode coating.

We have now devised an anode for use in diaphragm cells which aims to obviate or mitigate the disadvantages associated with the aforesaid anodes.

According to the present invention we provide an anode comprising a group of substantially parallel resiliently mounted bent elongated members made of a film-forming metal or alloy thereof carrying on at least part of their surfaces an electrocatalytically active coating, the members lying in a plane and extending lengthwise from the point of mounting.

Anodes having a single group of members may be mounted on the baseplate of a cell and each plane of elongated members will face (or touch) diaphragms which are conveniently deposited on the cathodes. Alternatively, each anode may comprise two groups of substantially parallel resiliently mounted bent elongated members, the members in each group lying in a plane and being conductively connected to each other and extending lengthwise from the point of mounting the planes facing each other and being substantially parallel to each other. When the anodes comprise two groups of elongated members, the members will face (or touch) adjacent diaphragms on either side of the anode.

Notwithstanding the bends associated with the elongated members, the planes of the members are substantially rectangular or square, and in the case of an anode having two such planes the elongated members defining an edge in one plane are electrically conductively connected to the members defining an edge in the other plane so that the two planes extend substantially parallel to one another from the edges that are connected.

According to a further aspect of the present invention we provide an electrolytic cell comprising a plurality of anodes, a plurality of cathodes and diaphragms separating the anodes and the cathodes, wherein each anode is according to the invention. The flexibility of the anodes enables the anodes to be positioned very close to the diaphragms and even impinge on the diaphragm without damaging it and without exerting undue pressure.

Elongated members which are made resilient by introducing one or more bends, are conveniently bent to form one or more loops. Each anode may suitably comprise one or two groups of elongated members in which the individual members are free at their ends remote from the point of mounting. Alternatively, when each anode comprises two groups of elongated members, opposing pairs of members in each group may be joined together at their ends remote from the point of mounting to form closed loops.

The elongated members are suitably in the form of wires or rods, especially wires of a film-forming metal such as titanium.

A suitable thickness for the wires or rods is in the range 1 to 6 mm, preferably 2 to 4 mm, e.g. 3mm.

The planes of elongated members comprising the anodes are preferably connected together by mounting on a support, for example by mounting on a bridgepiece of a film-forming metal, for example titanium. The bridgepiece is conveniently in the form of a rectangular block which may be connected to the planes of elongated members by any convenient means, for example resistance seam welding.

The anodes may be mechanically and electrically connected to the baseplate of the cell, for example a plate of a film-forming metal such as titanium, by any convenient method, for example by capacitor discharge stud welding or argon arc welding. The anodes may be mounted directly on the baseplate but are more conveniently mounted on studs of a film-forming metal (for example titanium) which are already mounted on the baseplate, the studs being arranged in parallel rows on the baseplate and spaced apart from one another in each row. Such studs are conveniently mounted on the baseplate by means of capacitor discharge stud welding. In an especially preferred form, the anodes are mounted on a bridgepiece as described above, and the bridgepiece is then mounted, for example by argon arc welding on the studs which have already been pre-mounted on the baseplate.

The film-forming metal baseplate may in turn be conductively bonded to a plate of iron or steel, for example a mild steel plate which serves as a conductor providing a low resistance electrical flow path between the anodes and copper connectors bolted to a side edge of the plate of iron or steel.

In this specification, by 'a film-forming metal' we mean one of the metals titanium, zirconium, niobium, tantalum or tungsten or an alloy consisting principally of one of these metals and having anodic polarisation properties which are comparable to those of the pure metal. It is preferred to use titanium alone or an alloy based on titanium and having polarisation properties comparable to those of titanium. Examples of such alloys are titanium-zirconium alloys containing up to 14% of zirconium, alloys of titanium with up to 5% of a platinum group metal such as platinum, rhodium or iridium and alloys of titanium with niobium or tantalum containing up to 10% of the alloying constituent.

The electrocatalytically active coating is a conductive coating which is resistant to electrochemical attack but is active in transferring electrons between electrolyte and the anode.

The electrocatalytically active material may suitably consist of one or more platinum group metals, i.e. platinum rhodium iridium, ruthenium, osmium and palladium, and alloys of the said metals, and/or the oxides thereof, or another metal or a compound which will function as an anode and which is resistant to electrochemical dissolution in the cell, for instance rhenium, rhenium trioxide, magnetite, titanium nitride and the borides, phosphides and silicides of the platinum group metals. The coating may consist of one or more of the said platinum group metals and/or oxides thereof in admixture with one or more non-noble metal oxides. Alternatively, it may consist of one or more non-noble metal oxides alone or a mixture of one or more non-noble metal oxides and a non-noble metal chloride discharge catalyst. Suitable non-noble metal oxides are, for example, oxides of the film-forming metals (titanium, zirconium, niobium, tantalum or tungsten), tin dioxide, germanium dioxide and oxides of antimony. Suitable chlorine-discharge catalysts include the difluorides of manganese, iron, cobalt, nickel and mixtures thereof. Especially suitable electrocatalytically active coatings according to the invention include platinum itself and those based on ruthenium dioxide/titanium dioxide and ruthenium dioxide/tin dioxide/titanium dioxide.

Other suitable coatings include those described in our UK Pat. No. 1402414 and UK Patent application No. 49898/73 (Belgian Pat. No. 149867) in which a non-conducting particulate or fibrous refractory material is embedded in a matrix of electrocatalytically active material (of the type described above). Suitable non-conducting particulate or fibrous materials include oxides, fluorides, nitrides, carbides and sulphides. Suitable oxides (including complex oxides) include zirconia, alumina, silica, thorium oxide, titanium dioxide, ceric oxide, hafnium oxide, ditantalum pentoxide, magnesium aluminate (e.g. spinel $MgO.Al_2O_3$) aluminosilicates (e.g. mullite $(Al_2O_3)_3(SiO_2)_2$), zirconium silicate, glass, calcium silicate (e.g. bellite $(CaO)_2SiO_2$), calcium aluminate, calcium titanate (e.g. perovskite $CaTiO_3$), attapulgite, kaolinite, asbestos, mica, codierite and bentonite; suitable sulphides include dicerium trisulphide, suitable nitrides include boron nitride and silicon nitride; and suitable fluorides include calcium fluoride. A preferred non-conducting refractory material is a mixture of zirconium silicate and zirconia, for example zirconium silicate particles and zirconia fibres.

The anodes of the invention may be prepared by the painting and firing technique, wherein a coating of metal and/or metal oxide is formed on the anode surface by applying a layer of a paint composition comprising thermally-decomposable compounds of each of the metals that are to feature in the finished coating in a liquid vehicle to the surface of the anode, drying the paint layer by evporating the liquid vehicle and then firing the paint layer by heating the coated anode, suitably at 250° C. to 800° C., to decompose the metal compounds of the paint and form the desired coating. When refractory particles or fibres are to be embedded in the metal and/or metal oxide of the coating, the refractory particles or fibres may be mixed into the aforesaid paint composition before it is applied to the anode. Alternatively, the refractory particles or fibres may be applied on to a layer of the aforesaid paint composition while this is still in the fluid state on the surface of the anode, the paint layer then being dried by evaporation of the liquid vehicle and fired in the usual manner.

The coating electrodes are preferably built up by applying a plurality of paint layers on the anode, each layer being dried and fired before applying the next layer.

The cathode may suitably be in the form of a perforated metal sheet or tube, for example in the form of a guaze.

The anode may be used in conjunction with any conventional diaphragm. Suitable diaphragms include those made of asbestos or a synthetic organic polymeric material, for example polytetrafluoroethylene or polyvinylidene fluoride.

The anode/cathode gap is as close to zero as possible, for example in the range up to 3mm.

The invention is especially applicable to diaphragm cells used for the manufacture of chlorine and alkali metal hydroxides by electrolysis of aqueous alkali metal chloride solutions, for example in diaphragm cells manufacturing chlorine and sodium hydroxide from sodium chloride solutions.

By way of example, embodiments of the anodes according to the invention will now be described with reference to the drawings in which FIG. 1 is a sectional end elevation of an anode assembly comprising pairs of open-ended looped flexible wires anodes mounted on the base plate of a cell.

Figure 2:
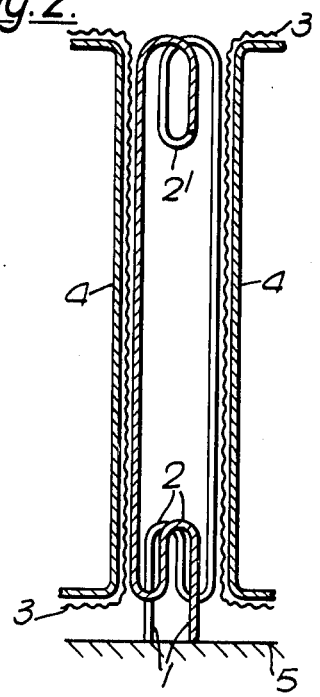
Figure 3:
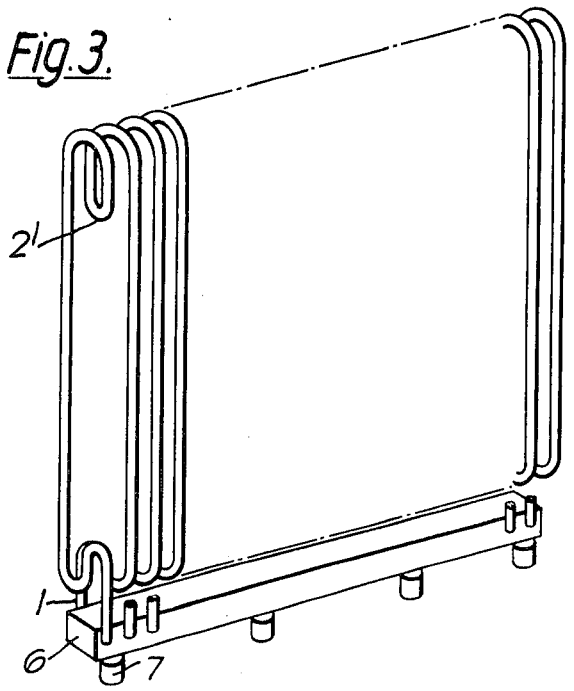

FIG. 2 is a sectional end elevation of an anode assembly comprising pairs of closed looped flexible wires anodes, joined at their ends and mounted on the base plate of a cell, and FIG. 3 is a diagrammatic view of an anode assembly of the type shown in FIG. 2, when mounted on a bridge piece and studs.

Referring to FIG. 1, the anode assembly comprises a plurality of pairs of wires 1, each of which is free at its top end and which is provided with a loop 2 at its lower end to impart flexibility. The wires 1 are arranged one behind another to form two parallel rows, each row being adjacent to a diaphragm 3 and a cathode 4.

Referring to FIGS. 2 and 3, the anode assembly comprises a plurality of pairs of wires 1, each of which is provided at its lower end with a loop 2 and wherein each wire is joined at its upper end to form a closed loop $2^1$, the loops 2 and $2^1$ imparting flexibility. The wires 1 are arranged one behind another to form effectively two parallel rows of anodes, each row being adjacent to a diaphragm 3 and a cathode 4.

The titanium wires 1 are provided with an electrocatalytically active coating (e.g. ruthenium oxide and titanium dioxide).

The diaphragm 3 is preferably of polytetrafluoroethylene and the cathode 4 is preferably of mild steel gauze.

The open-ended anode wires 1 (FIG. 1) are capacitor discharge stud welded at their lower ends to a titanium base plate 5. The closed loop anode wires (FIG. 2) are resistance welded or argon-arc welded to a titanium base plate 5. Alternatively, the closed loop wires 1 (FIG. 3) are resistance welded or argon-arc welded to a titanium bridge-piece 6, which is then resistance welded or argon-arc welded to titanium studs 7 previously capacitor discharge stud welded to the titanium base plate (not shown).

The titanium base plate is conductively bonded to a mild steel slab (not shown) which serves as a conductor providing a low-resistance electrical flow path between the anodes and copper conductors (not shown) bolted to a side edge of the mild steel slab.

The invention is further illustrated by the following Example:

A titanium wire (3mm diam.) anode (as shown in FIG. 3), coated with a mixture of ruthenium oxide and titanium dioxide, was assembled in a vertical laboratory diaphragm cell. The cell was provided with a mild steel gauze cathode and a polytetrafluoroethylene diaphragm. The anode/cathode gap was zero and the diaphragm was in contact with the cathode:

The cell was fed with sodium chloride brine (300 grams/litre NaCl), at a rate of 6 litres/hour and a current of 395 amp (equivalent to a current density of 2.0 $KA/m^2$) was passed through the cell. The cell operating voltage was 2.8 volts. The chlorine produced contained 98% by weight of $Cl_2$ and less than 0.1% by weight of $H_2$. The sodium hydroxide produced contained 9% by weight of NaOH. The cell operated at a current efficiency of 96%.

What we claim is:

1. An anode comprising a group of substantially parallel bent elongated flexible anode members resiliently mounted to a support, the members being made of a film-forming metal or alloy thereof carrying on at least part of their surfaces an electrocatalytically active coating, all of the members of the group being arranged side-by-side in generally a single plane and each of the members extending lengthwise from the point of mounting in a direction away from the base.

2. An anode as claimed in claim 1 wherein there are two groups of flexible anode members, the members in each group being conductively connected to each other and the planes of the groups facing each other and being substantially parallel to each other.

3. An anode as claimed in claim 2 wherein the planes are substantially rectangular or square, and the elongated members defining an edge in one plane are electrically conductively connected to the members defining an edge in the other plane so that the two planes extend substantially parallel to one another from the edges that are connected.

4. An anode as claimed in claim 2 wherein opposing pairs of elongated members in each group are fixed at their ends remote from the point of mounting to form closed loops.

5. An anode as claimed in claim 1 wherein the elongated members are bent to form one or more loops.

6. An anode as claimed in claim 1 wherein the elongated members in any one group are free at their ends remote from the point of mounting.

7. An anode as claimed in claim 6 wherein the support is a bridge piece of a film-forming metal or alloy thereof.

8. An anode as claimed in claim 1 wherein the elongated members are in the form of wires or rods.

9. An anode as claimed in claim 1 wherein the film-forming metal is titanium.

10. An anode as claimed in claim 1 whenever coated with a mixture of a platinum group metal oxide and a film-forming metal oxide.

11. An anode as claimed in claim 10 whenever coated with a mixture of ruthenium oxide and titanium dioxide.

12. An electrolytic cell comprising a plurality of anodes, a plurality of cathodes, and diaphragms separating the anodes and cathodes, and wherein each anode is as claimed in claim 1.

13. A cell as claimed in claim 12 wherein said support is a baseplate of the cell.

14. A cell as claimed in claim 13 wherein the baseplate is of a film-forming metal or alloy thereof.

15. A cell as claimed in claim 12 wherein said support is mounted on studs of a film-forming metal or alloy thereof which studs have been premounted on the baseplate of the cell.

16. A cell as claimed in claim 15 wherein the film-forming metal is titanium.

17. A cell as claimed in claim 12 wherein the anode/cathode gap is in the range up to 3 mm.

18. A cell as claimed in claim 12 wherein the cathode is of mild steel gauze.

19. A cell as claimed in claim 12 wherein the diaphragm comprises asbestos.

20. A cell as claimed in claim 12 wherein the diaphragm comprises polytetrafluoroethylene or polyvinylidene fluoride.

21. An electrolytic cell as in claim 12 wherein there are two groups of flexible anode members, the members in each group being conductively connected to each other and the planes of the groups facing each other and being substantially parallel to each other.

22. An electrolytic cell as in claim 21 wherein the planes are substantially rectangular or square, and the elongated members defining an edge in one plane are electrically conductively connected to the members defining an edge in the other plane so that the two planes extend substantially parallel to one another from the edges that are connected.

23. An anode comprising a rigid support; a group of substantially parallel elongated wires or rods made of a film-forming metal or alloy thereof carrying on at least a part of their surfaces an electrocatalytically active coating, each of said wires or rods having a flexible looped end portion fixed to said support, said elongated wires or rods being arranged side-by-side in generally a single plane and each of said wires or rods extending lengthwise from said support.

24. An electrolytic cell as in claim 12 wherein the elongated members are bent to form one or more loops.

25. An electrolytic cell as in claim 12 wherein the elongated members in any one group are free at their ends remote from the point of mounting.

26. An electrolytic cell as in claim 12 wherein the elongated members are in the form of wires or rods.

* * * * *